US008892006B2

(12) United States Patent
Kubo

(10) Patent No.: US 8,892,006 B2
(45) Date of Patent: Nov. 18, 2014

(54) DEVELOPING DEVICE AND IMAGE FORMING APPARATUS INCLUDING THE SAME

(75) Inventor: Norio Kubo, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 133 days.

(21) Appl. No.: 13/342,366

(22) Filed: Jan. 3, 2012

(65) Prior Publication Data

US 2012/0177411 A1 Jul. 12, 2012

(30) Foreign Application Priority Data

Jan. 12, 2011 (JP) ..... 2011-003605

(51) Int. Cl.
*G03G 15/08* (2006.01)
*G03G 15/01* (2006.01)

(52) U.S. Cl.
CPC .... *G03G 15/0893* (2013.01); *G03G 2215/0132* (2013.01); *G03G 15/0189* (2013.01)
USPC ..... 399/254

(58) Field of Classification Search
CPC ..... G03G 15/0889; G03G 15/0891; G03G 15/0887; G03G 15/0877; G03G 2215/0816; G03G 2215/0802; G03G 2215/0819; G03G 2215/0822; G03G 2215/0827; G03G 2215/085
USPC ..... 399/53, 142, 222, 234, 252, 254, 256, 399/262, 437
See application file for complete search history.

(56) References Cited

U.S. PATENT DOCUMENTS

2002/0051657 A1* 5/2002 Yuuki et al. ..... 399/254
2008/0038021 A1* 2/2008 Tsuda et al. ..... 399/254
2010/0239322 A1* 9/2010 Kido ..... 399/254

FOREIGN PATENT DOCUMENTS

JP 2001-265098 9/2001
JP 2006-323238 A 11/2006
JP 2010025987 A * 2/2010
JP 2010-072547 A 4/2010
JP 2010230760 A * 10/2010

* cited by examiner

*Primary Examiner* — Clayton E Laballe
*Assistant Examiner* — Victor Verbitsky
(74) *Attorney, Agent, or Firm* — Morgan, Lewis & Bockius LLP

(57) ABSTRACT

Provided is a developing device including: a first helical blade; a second helical blade formed at the same blade pitch as a blade pitch of the first helical blade; a developer discharge port for discharging surplus developer; and a regulating member formed in a reverse phase with respect to the first helical blade. When a proximity portion is at a position facing a communication portion, a blade apex portion of the second helical blade is arranged to fall within a range of from a position facing an end surface portion of the communication portion on a downstream side of the second conveyance path to a position immediately before a position facing the proximity portion, which is reached in accordance with a phase shift of the second helical blade. A first stirring member and a second stirring member are driven at the same rotational speed.

6 Claims, 6 Drawing Sheets

DEVELOPING DEVICE AND IMAGE FORMING APPARATUS INCLUDING THE SAME

INCORPORATION BY REFERENCE

This application is based on Japanese Patent Application No. 2011-003605 filed on Jan. 12, 2011, the contents of which are hereby incorporated by reference.

BACKGROUND

The present disclosure relates to a developing device to be used in an image forming apparatus such as a copier, a printer, a facsimile, and a composite apparatus having functions of those devices, and to an image forming apparatus including the developing device. In particular, the present disclosure relates to a developing device which replenishes a two-component developer including toner and carrier and discharges surplus developer and to an image forming apparatus including the developing device.

In image forming apparatuses, an electrostatic latent image formed on an image carrier including a photosensitive member and the like is developed by a developing device and visualized as a toner image. Examples of the developing device include one employing a two-component developing method in which a two-component developer is used. The developing device of this type includes a developing container in which a two-component developer including toner and carrier is stored, and there are arranged a developing roller for supplying the developer to the image carrier and a stirring member for supplying the developer in the developing container to the developing roller while stirring and conveying the developer.

In the developing device, the toner is consumed by a developing operation. Meanwhile, the carrier remains in the developing device without being consumed. Accordingly, even though the toner and the carrier are stirred in the developing container, the stirring frequency of the carrier increases, which causes deterioration of the carrier. As a result, charging performance of the carrier with respect to the toner is gradually deteriorated.

In this context, there has been proposed a developing device in which deterioration of charging performance of the carrier is suppressed by replenishment of developer including toner and carrier into a developing container and discharge of the developer including the carrier.

The developing device proposed above has the following configuration. Two stirring members each including a rotary shaft and a helical blade helically formed on an outer periphery of the rotary shaft are arranged in parallel with each other in respective conveyance paths. A partition member is provided between the conveyance paths, and communication portions for exchanging developer are provided to both end portions of the partition member. A developer discharge port is provided on a downstream side with respect to the conveyance path in a developer conveying direction. Between the stirring member and the developer discharge port, a discharge regulating member helically formed in a direction reverse to that of the helical blade of each of the stirring members is provided integrally with the rotary shaft. With this structure, when being replenished into the developing container, developer is conveyed to the downstream side of the conveyance path while being stirred by rotation of the stirring members. When the regulating member is rotated in the same direction as that of the stirring members, the regulating member imparts, to the developer, a conveyance force in a direction reverse to the developer conveying direction due to the stirring members. The developer is retained by the conveyance force in the reverse direction on the downstream side of the conveyance path and increased in height. As a result, surplus developer climbs over the regulating member so as to move to the developer discharge port, with the result of being discharged outside.

However, in the developing device proposed above, in accordance with the rotation of the stirring members, a proximity portion at which the helical blade and the regulating member become closest to each other periodically faces the communication portion, and the developer, which has been increased in height by the proximity portion, is periodically conveyed to the communication portion. In other words, this corresponds to fluctuation in amount of developer to be conveyed to the communication portion in accordance with the rotation of the stirring members. Accordingly, an amount of developer to move to the developer discharge port side fluctuates. As a result, there arises a problem that a discharge amount of the developer becomes unstable.

SUMMARY

It is an object of the present disclosure to provide a small-sized developing device having a simple configuration with which surplus developer is stably discharged from a developing container and a developer amount in the developing container is accurately maintained to a desired amount, and an image forming apparatus including the developing device.

According to one aspect of the present disclosure, there is provided a developing device, including: a first stirring member including a first helical blade extending along an axial direction around a rotary shaft; a second stirring member including a second helical blade formed at the same blade pitch as a blade pitch of the first helical blade, the second helical blade extending along an axial direction around a rotary shaft; a first conveyance path in which developer is conveyed from an upstream side to a downstream side by the first helical blade; a second conveyance path in which the developer is conveyed from the upstream side to the downstream side by the second helical blade and which extends adjacently to and in parallel with the first conveyance path; a partition member for separating the first conveyance path and the second conveyance path from each other; a communication portion provided on each end portion side of the partition member in a long side direction so as to circulate the developer in the first conveyance path and the second conveyance path; a developer replenishing port for replenishing developer into one of the first conveyance path and the second conveyance path; a developer discharge port formed at a downstream end portion of the first conveyance path, for discharging surplus developer; and a regulating member constructed of a helical blade which faces the developer discharge port and is provided around the rotary shaft of the first stirring member adjacently to the first helical blade, the helical blade being formed in a reverse phase with respect to the first helical blade, in which, when a proximity portion at which the first helical blade and the regulating member become closest to each other is at a position facing the communication portion, a blade apex portion of the second helical blade, which faces the partition member or the communication portion in a manner of becoming close thereto, is arranged to fall within a range of from a position facing an end surface portion of the communication portion on the downstream side of the second conveyance path to a position immediately before a position facing the proximity portion, which is reached in accordance with a phase shift of the second helical blade, and in which the first stirring member and the second stirring member are driven at the same rotational speed.

Further, according to another aspect of the present disclosure, there is provided a developing device, including: a first stirring member including a first helical blade extending along an axial direction around a rotary shaft; a second stirring member including a second helical blade formed at the same blade pitch as a blade pitch of the first helical blade, the second helical blade extending along an axial direction around a rotary shaft; a first conveyance path in which developer is conveyed from an upstream side to a downstream side by the first helical blade; a second conveyance path in which the developer is conveyed from the upstream side to the downstream side by the second helical blade and which extends adjacently to and in parallel with the first conveyance path; a partition member for separating the first conveyance path and the second conveyance path from each other; a communication portion provided on each end portion side of the partition member in a long side direction so as to circulate the developer in the first conveyance path and the second conveyance path; a developer replenishing port for replenishing developer into one of the first conveyance path and the second conveyance path; a developer discharge port formed at a downstream end portion of the first conveyance path, for discharging surplus developer; and a regulating member constructed of a helical blade which faces the developer discharge port and is provided around the rotary shaft of the first stirring member adjacently to the first helical blade, the helical blade being formed in a reverse phase with respect to the first helical blade, in which, when a proximity portion at which the first helical blade and the regulating member become closest to each other is at a position facing the communication portion, a blade apex portion of the second helical blade, which faces the partition member or the communication portion in a manner of becoming close thereto, is arranged to fall within a range of from a position facing an end surface portion of the communication portion on the downstream side of the second conveyance path to a position immediately before a position facing the proximity portion, which is reached in accordance with a phase shift of the second helical blade, and in which one of the first stirring member and the second stirring member is driven at a rotational speed corresponding to an integral multiple of a rotational speed of another of the first stirring member and the second stirring member.

Further features and advantages of the present disclosure will become apparent from the description of an embodiment given below.

DETAILED DESCRIPTION

In the following, embodiments of the present disclosure are described with reference to drawings, but the present disclosure is not limited to the embodiments. Further, use of the present disclosure, terms used herein, and the like are not limited to the embodiments as well.

Figure 1:
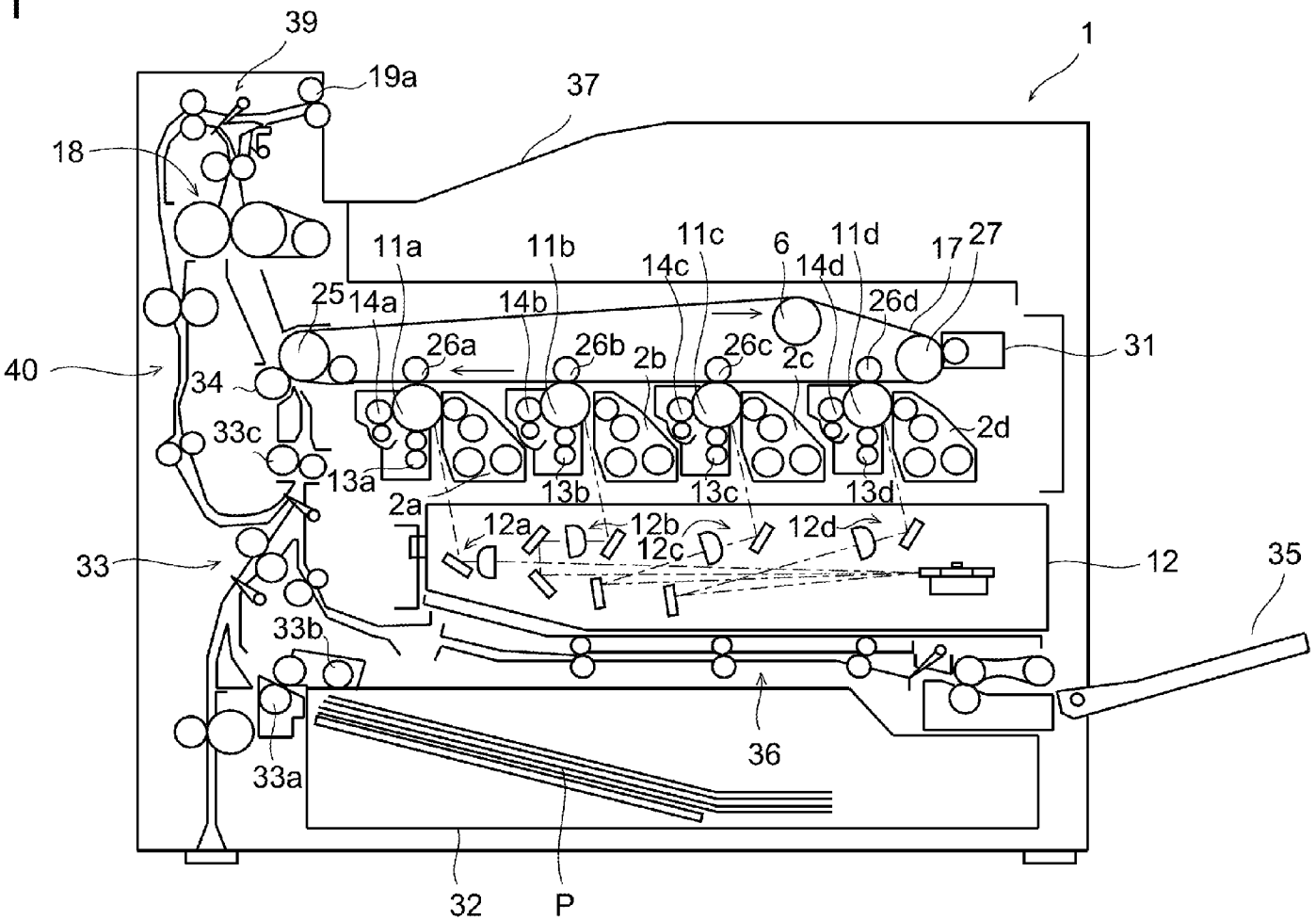
FIG. 1 is a view illustrating an image forming apparatus to which a developing device according to an embodiment of the present disclosure is mounted.

FIG. 1 is a view illustrating a configuration of an image forming apparatus to which a developing device according to an embodiment of the present disclosure is mounted. An image forming apparatus 1 is a tandem color printer, and has rotatable photosensitive members 11*a* to 11*d* for each of which an organic photosensitive member (OPC photosensitive member) is used as a photosensitive material forming a photosensitive layer and which are arranged correspondingly to the following respective colors: black, yellow, cyan, and magenta. Around the photosensitive members 11*a* to 11*d*, there are arranged developing devices 2*a* to 2*d*, exposure units 12*a* to 12*d*, charging portions 13*a* to 13*d*, and cleaning devices 14*a* to 14*d*, respectively.

The developing devices 2*a* to 2*d* are arranged respectively on the right of the photosensitive members 11*a* to 11*d* so as to face the photosensitive members 11*a* to 11*d*, and supply toners to the photosensitive members 11*a* to 11*d*. The charging portions 13*a* to 13*d* are arranged respectively on upstream sides of the developing devices 2*a* to 2*d* with respect to photosensitive-member rotational directions so as to face surfaces of the photosensitive members 11*a* to 11*d*, and uniformly charge the surfaces of the photosensitive members 11*a* to 11*d*.

The exposure unit 12 is provided for effecting scanning exposure on the photosensitive members 11*a* to 11*d* based on image data of characters, patterns, and the like, which have been input from personal computers and the like to an image input portion (not shown). The exposure unit 12 is provided below the developing devices 2*a* to 2*d*. The exposure unit 12 is provided with a laser light source and a polygon mirror, and reflecting mirrors and lenses are provided correspondingly to the photosensitive members 11*a* to 11*d*. A laser beam emitted from the laser light source is applied to each of the surfaces of the photosensitive members 11*a* to 11*d* from downstream sides of photosensitive-member rotational directions of the charging portions 13*a* to 13*d* through intermediation of the polygon mirror, the reflecting mirrors, and the lenses. The applied laser beam forms an electrostatic latent image on the surface of each of the photosensitive members 11*a* to 11*d*, and the electrostatic latent image is developed by each of the developing devices 2*a* to 2*d* into a toner image.

An endless intermediate transfer belt 17 is stretched around a tension roller 6, a drive roller 25, and a driven roller 27. The drive roller 25 is rotationally driven by a motor (not shown), and the intermediate transfer belt 17 is circulatingly driven by rotation of the drive roller 25.

The photosensitive members 11*a* to 11*d* are arranged adjacently to each other along a rotating direction (arrow direction of FIG. 1) below the intermediate transfer belt 17 so as to come into contact with the intermediate transfer belt 17. Primary transfer rollers 26*a* to 26*d* respectively face the photosensitive members 11*a* to 11*d* with the intermediate transfer belt 17 being sandwiched therebetween, and come into press contact with the intermediate transfer belt 17 so as to form a primary transfer portion thereon. In the primary transfer portion, the toner image on each of the photosensitive members 11*a* to 11*d* is sequentially transferred onto the intermediate transfer belt 17 at a predetermined timing with respect to rotation of the intermediate transfer belt 17. In this manner, a toner image obtained by superimposition of the toner images of the four colors: magenta, cyan, yellow, and black, is formed on a surface of the intermediate transfer belt 17.

A secondary transfer roller 34 faces the drive roller 25 with the intermediate transfer belt 17 being sandwiched therebetween, and comes into press contact with the intermediate transfer belt 17 so as to form a secondary transfer portion. In the secondary transfer portion, the toner image on the surface of the intermediate transfer belt 17 is transferred onto a sheet P. After the transfer of the toner image, a belt cleaning portion 31 removes residual toner left on the intermediate transfer belt 17.

A sheet-feeding cassette 32 for receiving the sheets P is arranged on a lower side of the image forming apparatus 1, and a stack tray 35 for feeding sheets that have been manually fed is arranged on the right of the sheet-feeding cassette 32. On the left of the sheet-feeding cassette 32, there is arranged a first sheet-conveyance path 33 for conveying the sheets P sent out from the sheet-feeding cassette 32 to the secondary transfer portion of the intermediate transfer belt 17. Further, on the left of the stack tray 35, there is arranged a second sheet-conveyance path 36 for conveying the sheets P sent out from the stack tray 35 to the secondary transfer portion. Further, on the upper left of the image forming apparatus 1, there are arranged a fixing portion 18 for performing fixing treatment with respect to the sheets P on which images are formed, and a third sheet-conveyance path 39 for conveying the sheets P subjected to the fixing treatment to a sheet delivery portion 37.

The sheet-feeding cassette 32 enables sheet replenishment by being drawn outside the apparatus (reader's side of FIG. 1), and the sheets P received therein are sent out one by one to the first sheet-conveyance path 33 side by a pick-up roller 33*b* and a fanning roller 33*a*.

The first sheet-conveyance path 33 and the second sheet-conveyance path 36 merge with each other before a registration roller pair 33*c*. The registration roller pair 33*c* times an image forming operation and a sheet-feeding operation on the intermediate transfer belt 17 to each other, and then the sheets P are conveyed to the secondary transfer portion. Each of the sheets P conveyed to the secondary transfer portion is subjected to secondary transfer of the toner image on the intermediate transfer belt 17 by the secondary transfer roller 34 applied with a bias potential, and then conveyed to the fixing portion 18.

The fixing portion 18 includes a fixing belt heated by a heater and the like, a fixing roller held in internal contact with the fixing belt, a pressure roller arranged while being held in press contact with the fixing roller with the fixing belt being held therebetween, and the like. The fixing portion 18 performs the fixing treatment by heating and pressurizing the sheets P onto which the toner images are transferred. After the toner image is fixed in the fixing portion 18, each of the sheets P is inverted in a fourth sheet-conveyance path 40 when necessary, and a rear surface of each of the sheets P is also subjected to secondary transfer of a toner image by the secondary transfer roller 34. Then, the toner image is fixed in the fixing portion 18. The sheets P on each of which the toner image is transferred pass through the third sheet-conveyance path 39, and then delivered onto a sheet delivery portion 37 by a delivery roller pair 19*a*.

Figure 2:
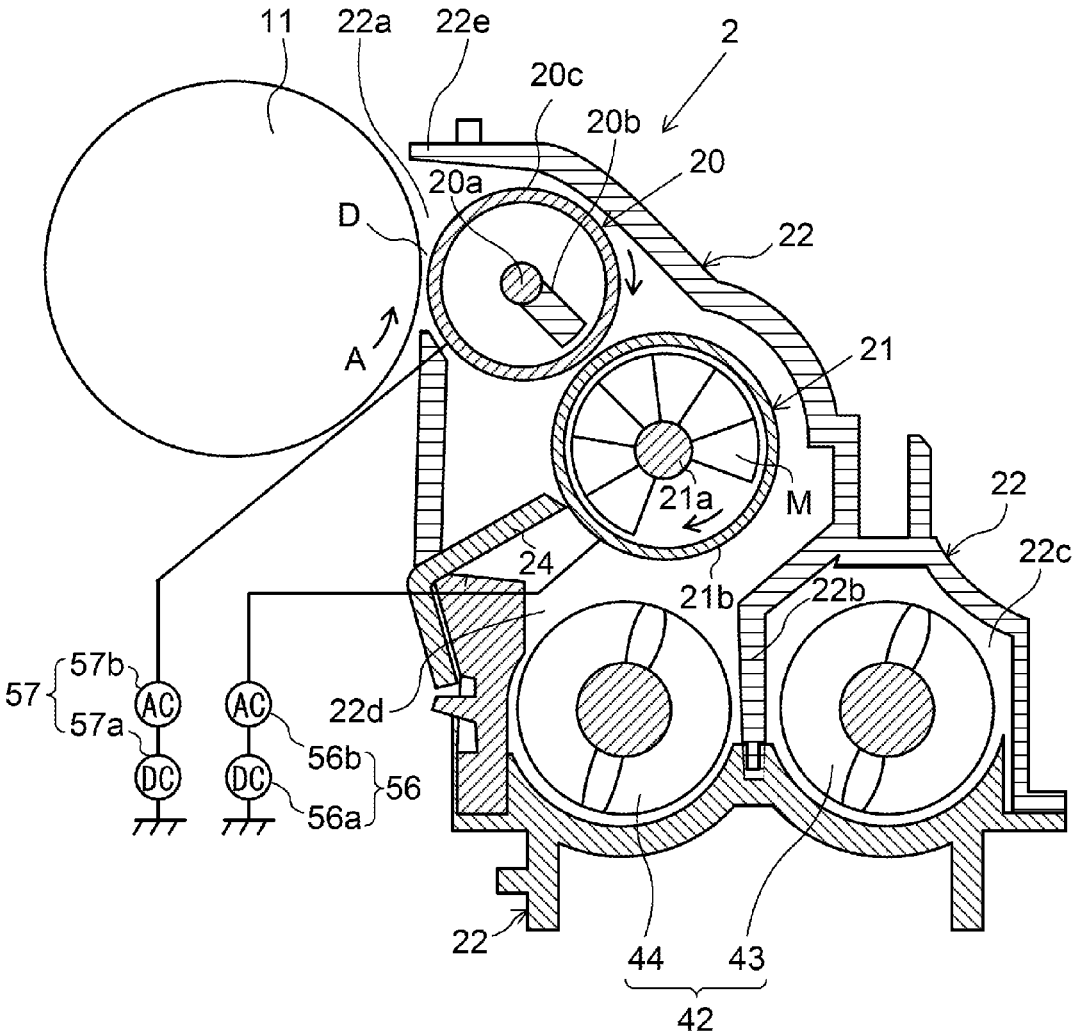
FIG. 2 is a sectional view of the developing device according to the embodiment of the present disclosure.

FIG. 2 is a sectional view illustrating a configuration of the developing device to be used in the above-mentioned image forming apparatus 1. Note that, although the following description is made only of a configuration and an operation of the developing device 2*a* corresponding to the photosensitive member 11*a* illustrated in FIG. 1, the configurations and operations of the developing devices 2*b* to 2*d* are the same as those of the developing device 2*a*. Thus, description thereof and reference symbols a to d indicating the developing devices and the photosensitive members of the respective four colors are omitted.

The developing device 2 includes a developing roller 20, a magnetic roller 21, a regulating blade 24, a stirring portion 42, and a developing container 22.

The developing container 22 constitutes an outer casing of the developing device 2, and includes a lower portion partitioned into a first conveyance path 22*d* and a second conveyance path 22*c* by a partition member 22*b*. A developer including toner and carrier is stored in the first conveyance path 22*d* and the second conveyance path 22*c*. Further, the developing container 22 rotatably holds stirring members of the stirring portion 42, the magnetic roller 21, and the developing roller 20. Still further, the developing container 22 is provided with an opening 22*a* for exposing the developing roller 20 to the photosensitive member 11.

The developing roller 20 faces the photosensitive member 11, and is arranged on the right of the photosensitive member 11 at a certain interval. Further, the developing roller 20 forms, at a facing position near the photosensitive member 11, a developing region D in which toner is supplied to the photosensitive member 11. The magnetic roller 21 faces the developing roller 20 at a certain interval, and is arranged on the diagonally lower right of the developing roller 20. Further, the magnetic roller 21 supplies toner to the developing roller 20 at the facing position near the developing roller 20. The regulating blade 24 is fixedly held by the developing container 22 on the diagonally lower left of the magnetic roller 21. The stirring portion 42 is arranged substantially below the magnetic roller 21.

The stirring portion 42 includes two members: a first stirring member 44; and a second stirring member 43. Below the magnetic roller 21, the first stirring member 44 is provided in the first conveyance path 22*d*. On the right of the first stirring member 44, the second stirring member 43 is provided adjacently thereto in the second conveyance path 22*c*.

The first stirring member 44 and the second stirring member 43 stir developer so that toner in the developer is charged to a predetermined level. In this manner, the toner is held by carrier. Communication portions (not shown) are provided at both end parts in a long side direction (direction between the reader's side and the side opposite to the reader's side of FIG. 2) of the partition member 22*b* for partitioning the developing container 22 into the first conveyance path 22*d* and the second conveyance path 22*c*. When the second stirring member 43 is rotated, the charged developer is conveyed from the second conveyance path 22*c* through one of the communication portions into the first conveyance path 22*d*, and circulates inside the first conveyance path 22*d* and the second conveyance path 22*c*. Then, the developer is supplied from the first stirring member 44 to the magnetic roller 21.

The magnetic roller 21 includes a roller shaft 21*a*, a magnetic-pole member M, and a rotary sleeve 21*b* constructed of a non-magnetic member. The magnetic roller 21 holds the developer supplied from the first stirring member 44 and supplies only toner of the held developer to the developing roller 20. The magnetic-pole member M is constructed of a plurality of magnets having different polarities arranged at outer peripheral portions each of which is formed to have a sector shape in cross section. The magnetic-pole member M is firmly attached to the roller shaft 21*a* by bonding or the like. The roller shaft 21*a* is non-rotatably supported by the developing container 22 in the rotary sleeve 21*b* with a predetermined interval provided between the magnetic-pole member M and the rotary sleeve 21*b*. The rotary sleeve 21*b* is rotated in an arrow direction (clockwise direction) in FIG. 2 by a driving mechanism including a motor and gears (not shown), and is applied with a bias 56 obtained by superimposition of an alternating voltage 56*b* onto a direct voltage 56*a*. On a surface of the rotary sleeve 21*b*, the charged developer is held with a magnetic brush being formed by a magnetic force of the magnetic-pole member M, and the magnetic brush is adjusted to have a predetermined height by the regulating blade 24.

In accordance with rotation of the rotary sleeve 21*b*, the magnetic brush is conveyed while being held on the surface of the rotary sleeve 21*b* by the magnetic-pole member M, and then raised at a facing portion of the magnetic roller 21 and the developing roller 20 by a magnetic-pole member 20*b* provided in the developing roller 20. When the magnetic brush thus raised comes into contact with the developing roller 20, only toner of the magnetic brush is supplied to the developing roller 20 in accordance with the bias 56 applied to the rotary sleeve 21*b*.

The developing roller 20 includes a fixing shaft 20*a*, the magnetic-pole member 20*b*, and a developing sleeve 20*c* constructed of a non-magnetic material.

The fixing shaft 20*a* is non-rotatably supported by the developing container 22. The developing sleeve 20*c* is rotatably held by the fixing shaft 20*a*, and the magnetic-pole member 20*b* formed of a magnet is firmly attached by bonding or the like to a position facing the magnetic roller 21 at a certain interval with respect to the developing sleeve 20*c*. The developing sleeve 20*c* is rotated in the same direction as the magnetic roller 21 (clockwise direction) by a driving mechanism including a motor and gears (not shown). Further, the developing sleeve 20*c* is applied with a developing bias 57 obtained by superimposition of an alternating voltage 57*b* onto a direct voltage 57*a*.

When the developing sleeve 20*c* is applied with the developing bias 57, a potential difference between a developing bias potential and a potential of an exposed part of the photosensitive member 11 causes the toner held on a surface of the developing sleeve 20*c* to fly to the photosensitive member 11 in the developing region D. Particles of the toner having flown sequentially adhere to the exposed part on the photosensitive member 11 rotated in an arrow A direction (counterclockwise direction), and the electrostatic latent image on the photosensitive member 11 is developed.

Figure 3:
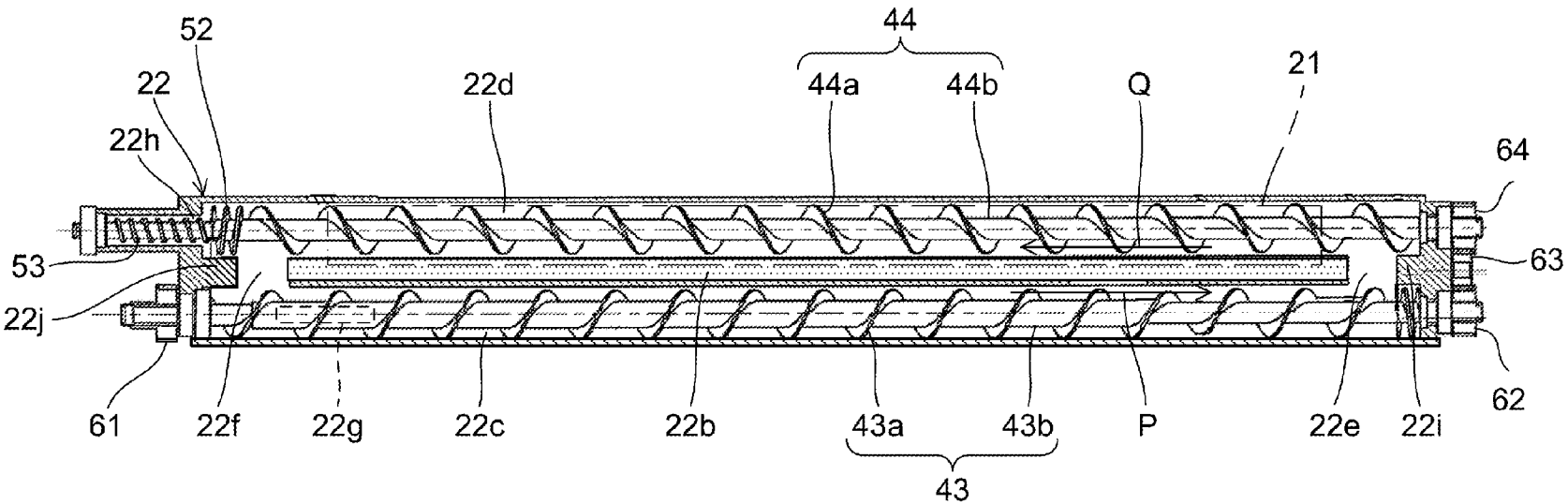
FIG. 3 is a plan sectional view of a stirring portion of the developing device according to the embodiment of the present disclosure.

Next, detailed description is made of a stirring portion of the developing device with reference to FIG. 3. FIG. 3 is a plan sectional view of the stirring portion when viewed from above.

As described above, the developing container 22 is provided with the first conveyance path 22*d*, the second conveyance path 22*c*, the partition member 22*b*, and communication portions 22*e* and 22*f*. In addition, the developing container 22 is provided with a developer replenishing port 22*g* and a developer discharge port 22*h*.

The partition member 22*b* extends along a long side direction of the developing container 22, and performs partitioning so as to partition the developing container 22 into the first conveyance path 22*d* and the second conveyance path 22*c* parallel with each other. A right end portion of the partition member 22*b* in the long side direction forms the communication portion 22*e* together with an inner wall portion of a side wall portion 22*i*. Meanwhile, a left end portion of the partition member 22*b* in the long side direction forms the communication portion 22*f* together with an inner wall portion of a side wall portion 22*j*. The developer is allowed to circulate inside the second conveyance path 22*c*, the communication portion 22*e*, the first conveyance path 22*d*, and the communication portion 22*f* in a counterclockwise direction.

The developer replenishing port 22*g* is an opening for replenishing new toner and carrier into the developing container 22 from a developer replenishing container (not shown) provided to an upper portion of the developing container 22, and is arranged on an upstream side of the second conveyance path 22*c* (left side of FIG. 2).

The developer discharge port 22*h* is an opening for discharging developer which has become surplus due to replenishment of developer in the first conveyance path 22*d* and the second conveyance path 22*c*, and is formed in the side wall portion 22*j*. Thus, the developer discharge port 22*h* is provided at an inner position in the first conveyance path 22*d* on a downstream side of the first conveyance path 22*d*.

The first stirring member 44 is arranged in the first conveyance path 22*d*, and the second stirring member 43 is arranged in the second conveyance path 22*c*.

The second stirring member 43 includes a rotary shaft 43*b* and a second helical blade 43*a* provided integrally with the rotary shaft 43*b* and helically formed at a certain pitch in an axial direction of the rotary shaft 43*b*. Further, the second helical blade 43*a* is provided so as to extend to both-end-portion sides of the second conveyance path 22*c* in a long side direction and to face the communication portion 22*e* and the communication portion 22*f*. The rotary shaft 43*b* is rotatably and axially supported by the side wall portion 22*i* and the side wall portion 22*j* of the developing container 22.

The first stirring member 44 includes a rotary shaft 44*b* and a first helical blade 44*a* provided integrally with the rotary shaft 44*b*. The first helical blade 44*a* is helically formed, in an axial direction of the rotary shaft 44*b*, of a blade directed in a direction reverse to that of the second helical blade 43*a*, that is, a reverse phase blade, and having the same pitch as that of the second helical blade 43*a*. Further, the first helical blade 44*a* is provided so as to have a length equal to or longer than an axial length of the magnetic roller 21, and further, to face the communication portion 22*e*. The rotary shaft 44*b* is arranged in parallel with the rotary shaft 43*b*, and rotatably and axially supported by the side wall portion 22*i* and the side wall portion 22*j* of the developing container 22.

Further, together with the first helical blade 44*a*, a discharge blade 53 and a reverse helical blade 52 which constitute a regulating member are arranged integrally with the rotary shaft 44*b*.

The reverse helical blade 52 enables the developer having been conveyed to the downstream side in the first conveyance path 22*d* to be retained and the developer to be conveyed to the communication portion 22*f*. In addition, the reverse helical blade 52 enables developer having exceeded a predetermined volume in the first conveyance path 22*d* to be conveyed to the developer discharge port 22*h*.

In other words, the reverse helical blade 52 is helically formed of a reverse phase blade of the first helical blade 44*a*, which is a twice-to-thrice wound blade having a pitch smaller than that of the first helical blade 44*a*. The reverse helical blade 52 is formed adjacently to one end of the first helical blade 44*a* so as to face the developer discharge port 22*h*. An adjacent portion of the reverse helical blade 52 and the first helical blade 44*a* is provided at a position facing the communication portion 22*f*. By arranging the adjacent portion in a manner of facing the communication portion 22*f*, the developing device can be downsized in the axial direction even when the developer discharge port is provided.

Further, the reverse helical blade 52 is arranged so that a predetermined interval is secured between an outer periphery thereof and an inner peripheral surface of the first conveyance path 22*d*, the inner peripheral surface being formed on the side wall portion 22*j*. Thus, when the reverse helical blade 52 is rotated, the reverse helical blade 52 imparts, to the developer, a conveyance force in a direction reverse to the developer conveying direction due to the first helical blade 44*a*. In this manner, the developer is retained. The developer thus retained is conveyed to the communication portion 22*f*, and surplus part of the developer climbs over the outer edge of the reverse helical blade 52, with the result of being discharged from the developer discharge port 22*h*.

The rotary shaft 44*b* is formed so as to further extend from the developer discharge port 22*h*. The discharge blade 53 is provided on a part of the rotary shaft 44*b*, which extends from the developer discharge port 22*h*. Although being constructed of a helical blade directed in the same direction as that of the first helical blade 44*a*, the discharge blade 53 has a pitch smaller than that of the first helical blade 44*a*, and an outer diameter of the blade smaller than that of the first helical blade 44*a*. Accordingly, the discharge blade 53 is rotated in accordance with rotation of the rotary shaft 44*b*, and the surplus developer conveyed into the developer discharge port 22*h* after climbing over the reverse helical blade 52 is sent to the left side of FIG. 3 and discharged outside the developing container 22. Note that, the discharge blade 53, the reverse helical blade 52, and the first helical blade 44*a* are molded of a synthetic resin integrally with the rotary shaft 44*b*.

Gears 61 to 64 are arranged on an outer wall of the developing container 22. The gears 61 and 62 are firmly attached to the rotary shaft 43*b*, the gear 64 is firmly attached to the rotary shaft 44*b*, and the gear 63 and other gears (not shown) are rotatably held by the developing container 22 so as to mesh with the gears 62 and 64.

Accordingly, when the gear 61 is rotated by a drive source such as a motor at the time of development, the second helical blade 43*a* is rotated together with the rotary shaft 43*b*. Then, the developer is conveyed in an arrow P direction by the second helical blade 43*a* while being stirred in the first conveyance path 22*d*, and after that, passes through the communication portion 22*e* so as to be conveyed into the first conveyance path 22*d*. Further, when the rotary shaft 44*b* provided in association with the rotary shaft 43*b* is rotated, the developer is conveyed in an arrow Q direction by the first helical blade 44*a* while being stirred in the first conveyance path 22*d*. Although the developer is conveyed in the first conveyance path 22*d* by rotation of the first helical blade 44*a*, the developer is retained by the reverse helical blade 52. Thus, without climbing over the reverse helical blade 52, the developer is conveyed into the second conveyance path 22*c* through the communication portion 22*f*.

As described above, the developer is stirred while circulating through the second conveyance path 22*c*, the communication portion 22*e*, the first conveyance path 22*d*, and the communication portion 22*f* in the stated order. After being stirred, the developer is supplied to the magnetic roller 21.

Next, description is made of a case where developer is supplied from the developer replenishing port 22*g*. When toner is consumed by developing, developer including toner and carrier is replenished from the developer replenishing port 22*g* into the second conveyance path 22*c*.

The developer thus replenished is conveyed in the arrow P direction by the second helical blade 43*a* while being stirred in the second conveyance path 22*c*, and after that, passes through the communication portion 22*e* so as to be conveyed into the first conveyance path 22*d*. Further, the developer is conveyed in the arrow Q direction by the first helical blade 44*a* while being stirred in the first conveyance path 22*d*. When the reverse helical blade 52 is rotated in accordance with the rotation of the rotary shaft 44*b*, the developer near the reverse helical blade 52 is retained by the reverse helical blade 52 and conveyed in a direction to the communication portion 22*f*. In addition, the developer is replenished and increased in volume, and hence exceeds a height of the reverse helical blade 52 near the reverse helical blade 52. As a result, surplus developer climbs over the reverse helical blade 52 so as to be discharged from the developer discharge port 22*h*.

Figure 4:
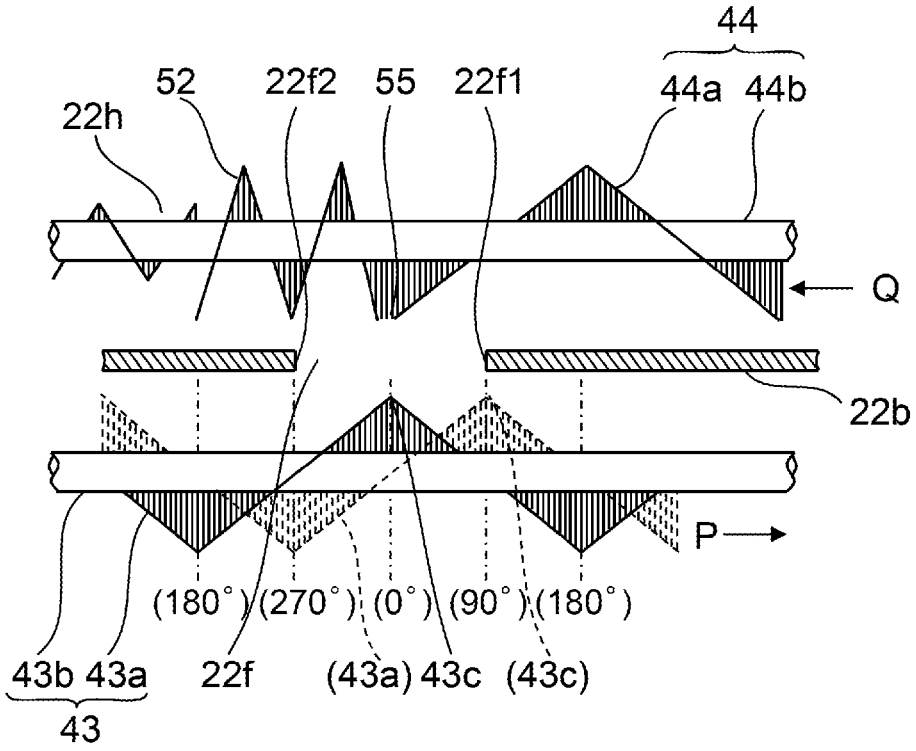
FIG. 4 is a plan view schematically illustrating main part of stirring members according to the embodiment of the present disclosure.

Next, with reference to FIG. 4, detailed description is made of how the surplus developer is discharged and how developer is conveyed to the communication portion 22*f* near the reverse helical blade 52. FIG. 4 is a plan view viewed from above, schematically illustrating the first stirring member 44 and the second stirring member 43 near the communication portion 22*f*.

When the first stirring member 44 is rotated, developer is conveyed in the arrow Q direction while being stirred. As described above, the developer near the reverse helical blade 52 is conveyed to both the developer discharge port 22*h* and the communication portion 22*f*. In this context, the reverse helical blade 52 and the first helical blade 44*a* are arranged adjacently to each other, and the reverse helical blade 52 and the first helical blade 44*a* are formed in a reverse phase with respect to each other. Thus, there is formed a proximity portion 55 at which the reverse helical blade 52 and the first helical blade 44*a* become closest to each other as a result of gradually becoming close to each other at a position around the rotary shaft 44*b*. At the proximity portion 55, the developer retained by the reverse helical blade 52 is further increased in height in comparison with those at other positions around the rotary shaft 44*b*. Further, in accordance with the rotation of the first stirring member 44, the proximity portion 55 comes to various rotational positions such as a rotational position facing the communication portion 22*f* and a position facing a side opposite to the communication portion 22*f*.

In accordance with the rotational positions of the proximity portion 55, the developer near the reverse helical blade 52 varies in height, and hence the developer which is conveyed to the developer discharge port 22*h* side after climbing over the reverse helical blade 52 varies in amount. Specifically, in a case where the proximity portion 55 is at the rotational position facing the communication portion 22*f* (in a case of FIG. 4), in comparison with developer in the case where the proximity portion 55 is at another rotational position such as the position facing the side opposite to the communication portion 22*f*, developer in the region facing the communication portion 22*f* is further increased in height. Thus, much developer is conveyed to the communication portion 22*f* side.

Meanwhile, when the second stirring member 43 is rotated, a blade apex portion 43*c* of the second helical blade 43*a* moves to the right side of FIG. 4 (from a solid line position to a broken line position) in accordance with a phase shift of the helical blade. Thus, developer is conveyed in the arrow P direction while being stirred. Note that, the blade apex portion 43*c* is a predetermined one of peak portions of the second helical blade 43*a*, specifically, a predetermined one of apexes of the peak portions of the second helical blade 43*a*, which faces the partition member 22*b* or the communication portion 22*f* in a closest state with respect thereto. Further, when the second stirring member 43 is rotated at 90°, the blade apex portion 43*c* moves from the solid line position to the broken line position in FIG. 4.

In accordance with the rotation of the second stirring member 43, the blade apex portion 43*c* faces the proximity portion 55 of the first helical blade 44*a* at the solid line position (0°), in other words, at a substantially central position of the communication portion 22*f*. In this state, when the second stirring member 43 is rotated at 90°, the blade apex portion 43*c* comes to a position of (90°) and faces an end surface portion 22*f*1 of the communication portion 22*f* on the downstream side of the second conveyance path 22*c*. When the second stirring member 43 is rotated at 180°, the blade apex portion 43*c* comes to a position of (180°) and does not face the communication portion 22*f*. When the second stirring member 43 is rotated at 270°, the blade apex portion 43*c* comes to a position of (270°) and faces an end surface portion 22*f*2 of the communication portion 22*f* on the upstream side of the second conveyance path 22*c*. When the second stirring member 43 is rotated at 360°, the blade apex portion 43*c* returns to the position of (0°).

Further, in accordance with the rotation of the second stirring member 43, the second helical blade 43*a* conveys developer in the arrow P direction, and the peak portions of the helical blade spread the developer to an outer peripheral side. Specifically, the apexes of the peak portions of the helical blade spread the developer most. In other words, the blade apex portion 43*c* spreads the developer most to the partition member 22*b* side or the communication portion 22*f* side. In accordance therewith, on a rear side in a moving direction of the blade apex portion 43*c* (left side of the blade apex portion 43*c* in FIG. 4), the developer amount is small. In other words, when the blade apex portion 43*c* falls within a range of from the position of (0°) to the position of (90°), the developer amount is small in a region in the second conveyance path 22*c*, the region facing the communication portion 22*f*.

Thus, when the proximity portion 55 of the first helical blade 44*a* is at the rotational position facing the communication portion 22*f*, much developer is conveyed by the proximity portion 55 to the communication portion 22*f* side. Meanwhile, when the blade apex portion 43*c* of the second helical blade 43*a* falls within the range of from the position of (0° to the position of (90°), the developer amount around the second helical blade 43*a* is small in the region in the second conveyance path 22*c*, the region facing the communication portion 22*f*. With this, developer to be conveyed by the first helical blade 44*a* to the communication portion 22*f* side more easily enters the second conveyance path 22*c*. As a result, less developer is conveyed to the developer discharge port 22*h* side.

Meanwhile, even in the case where the proximity portion 55 of the first helical blade 44*a* is at the rotational position facing the communication portion 22*f* and much developer is conveyed to the communication portion 22*f* side, when the blade apex portion 43*c* of the second helical blade 43*a* falls within an effective angular range of from the position of (90°) to a position immediately before the position of (0°) via the position of (180°) and the position of (270°), the peak portions of the second helical blade 43*a* spread the developer to the outer peripheral side of the blade. Thus, the developer to be conveyed by the first helical blade 44*a* to the communication portion 22*f* side is pushed back to the first conveyance path 22*d* side, with the result of being suppressed from entering the second conveyance path 22*c*.

Therefore, in the case where the proximity portion 55 of the first helical blade 44*a* is at the rotational position facing the communication portion 22*f*, when the first stirring member 44 and the second stirring member 43 are rotationally driven so that the blade apex portion 43*c* of the second stirring member 43 falls within the above-mentioned effective angular range, the developer moves to the developer discharge port 22*h* side as in the case where the proximity portion 55 of the first helical blade 44*a* is at the rotational position not facing the communication portion 22*f*. As a result, a discharge amount of the developer is constantly stabilized.

In order to achieve those advantages, the first stirring member 44 and the second stirring member 43 are incorporated in the developing container 22 (refer to FIG. 3) in a manner that the proximity portion 55 of the first helical blade 44*a* is arranged at the position facing the communication portion 22*f*, and that the blade apex portion 43*c* of the second helical blade 43*a* is arranged at the position that falls within the effective angular range. Next, the first stirring member 44 and the second stirring member 43 are held in the above-mentioned arrangement state, and the gear 61 (refer to FIG. 3) is meshed with a drive gear of the motor (not shown). Further, the gear 64 (refer to FIG. 3) provided to the first stirring member 44 and the gear 62 (refer to FIG. 3) provided to the second stirring member 43 have the same number of teeth. By being rotationally driven by the motor, the first stirring member 44 and the second stirring member 43 are rotated at the same speed. Thus, when the proximity portion 55 of the first helical blade 44*a* comes to the rotational position facing the communication portion 22*f*, the blade apex portion 43*c* of the second helical blade 43*a* comes to a rotational position within the above-mentioned effective angular range. With this, irrespective of the rotational position of the first helical blade 44*a*, a discharge amount of surplus developer is stabilized. When the second stirring member 43 is assembled with respect to the first stirring member 44 so as to stabilize the discharge amount of the developer, the effective angular range is wide, and thus the first stirring member 44 and the second stirring member 43 are easily assembled even when attachment positions of the gears are slightly displaced.

Note that, one of the first stirring member 44 and the second stirring member 43 may be rotationally driven at a rotational speed corresponding to an integral multiple of that of another of the first stirring member 44 and the second stirring member 43. For example, when the number of teeth of the gear 62 (refer to FIG. 3) of the second stirring member 43 is set to be twice as many as the number of teeth of the gear 64 (refer to FIG. 3) of the first stirring member 44, a rotational speed of the second stirring member 43 is set to ½ of a rotational speed of the first stirring member 44. In this case, the blade apex portion 43*c* of the second helical blade 43*a* reaches a predetermined rotational position in the effective angular range for every two rotations of the first stirring member 44, and at this time, the proximity portion 55 of the first stirring member 44 faces the communication portion 22*f*. As a result, the discharge amount of the surplus developer is stabilized.

Further, as described above in this embodiment, the blade apex portion 43*c* and the proximity portion 55 do not necessarily face each other at substantially the central position of the communication portion 22*f* as long as the facing position is within the range corresponding to the communication portion 22*f*. Further, there has been illustrated a configuration in which a width of the communication portion 22*f* is set such that the blade apex portion 43*c* moves from the end surface portion 22*f*2 of the communication portion 22*f* on the upstream side of the second conveyance path 22*c* to the end surface portion 22*f*1 of the communication portion 22*f* on the downstream side of the second conveyance path 22*c* during a 180°-rotation of the second stirring member 43, but the present disclosure is not limited thereto. For example, in accordance with the amount of the developer to be conveyed from the first conveyance path 22*d* to the second conveyance path 22*c*, the width of the communication portion 22*f* may be set larger or smaller than that in the above-mentioned configuration.

Figure 5:
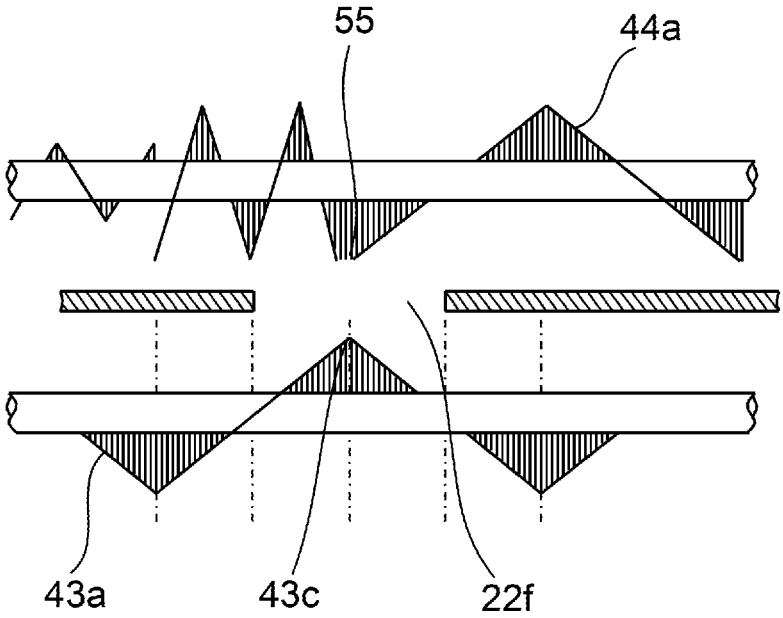
FIG. 5 is a plan view schematically illustrating arrangement of a first helical blade and a second helical blade of the stirring members according to a comparison example of the present disclosure.
Figure 6:
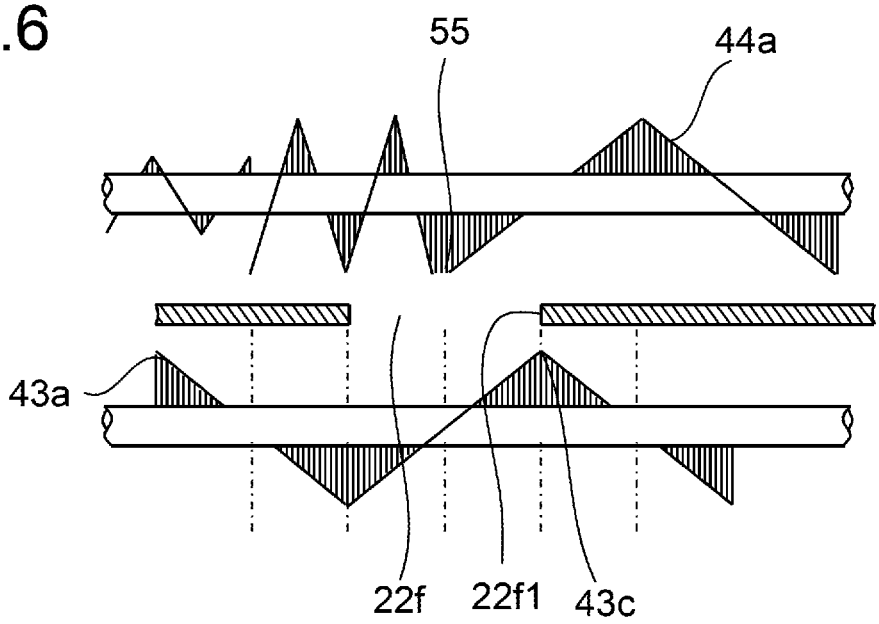
FIG. 6 is a plan view schematically illustrating the arrangement of the first helical blade and the second helical blade of the stirring members according to a first example of the present disclosure.
Figure 7:
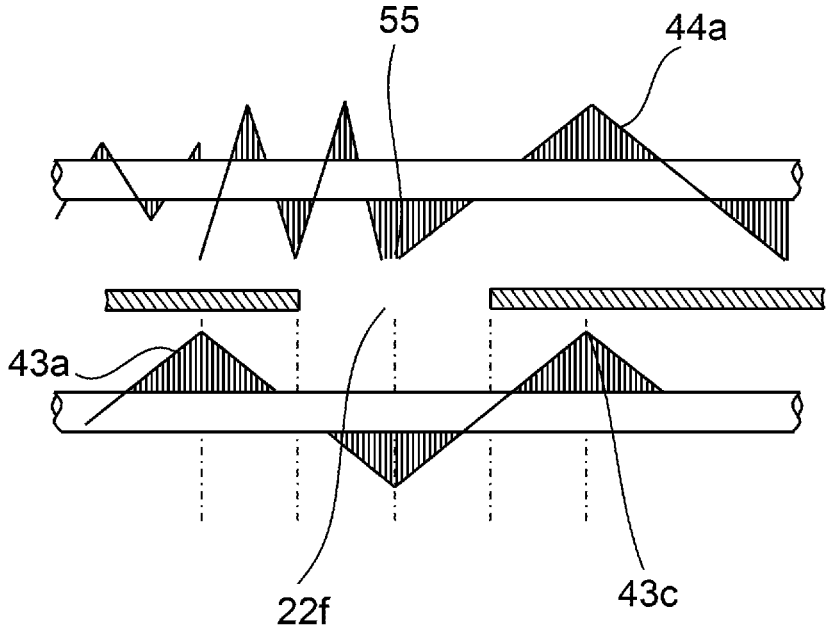
FIG. 7 is a plan view schematically illustrating the arrangement of the first helical blade and the second helical blade of the stirring members according to a second example of the present disclosure.
Figure 8:
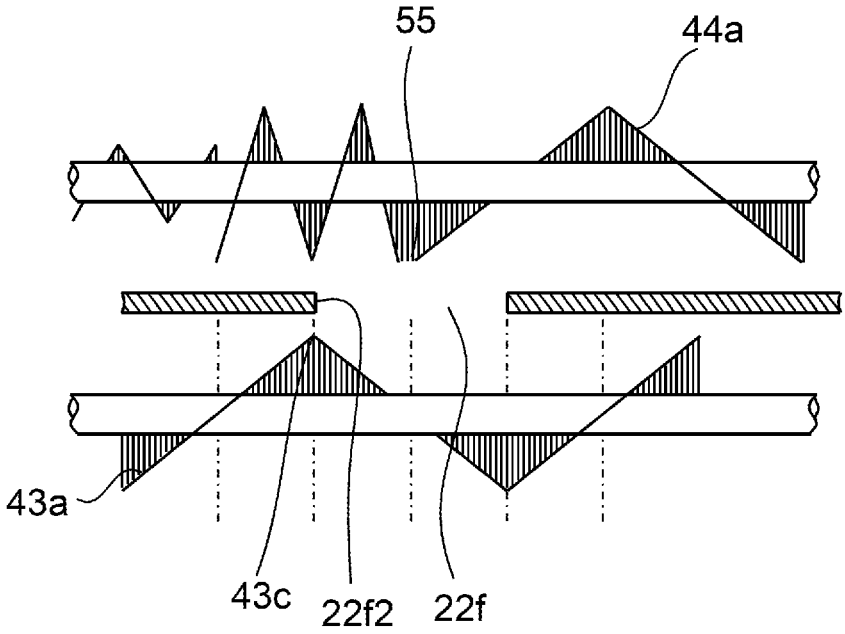
FIG. 8 is a plan view schematically illustrating the arrangement of the first helical blade and the second helical blade of the stirring members according to a third example of the present disclosure.

In the following, more specific description is made by means of examples. Note that, the present disclosure is not limited to those examples at all. FIGS. 5 to 8 are each a plan view viewed from above, schematically illustrating arrangement of the first stirring member 44 and the second stirring member 43 near the communication portion 22*f*. FIG. 5 illustrates a comparison example A, FIG. 6 illustrates a first example, and FIG. 7 illustrates a second example. Further, FIG. 8 illustrates a third example.

The developing roller 20 used in each of the first to third examples and the comparison example A has an outer diameter of 20 mm and is rotated at 282 rpm, and the magnetic roller 21 has an outer diameter of 20 mm and is rotated at 282 rpm. In the first stirring member 44, the first helical blade 44*a* has an outer diameter of 16 mm, the blade pitch is 30 mm (one-row winding), and further, the rotary shaft 44*b* has a shaft diameter of 8 mm and is rotated at 315 rpm. The reverse helical blade 52 has an outer diameter of 16 mm, and the blade pitch is 5 mm and is 2.5-row winding. Meanwhile, in the second stirring member 43, the second helical blade 43*a* has an outer diameter of 16 mm, the blade pitch is 30 mm (one-row winding), and further, a shaft diameter of the rotary shaft 43*b* is 8 mm and is rotated in the same direction as the first helical blade 44*a* at 315 rpm. The opening width of the communication portion 22*f* of the developing container 22 is 15 mm.

Toner in the developing container 22 has an average particle diameter of 6.8 μm, carrier has an average particle diameter of 35 μm, and weight percentage of the toner with respect to the carrier is 9%. In new developer replenished into the developing container 22, weight percentage of carrier with respect to toner is 10%.

In the comparison example A and the first to third examples, the proximity portion 55 of the first helical blade 44*a* was set in a state facing substantially the center of the communication portion 22*f* in the above-mentioned configuration. In the comparison example A (FIG. 5), the blade apex portion 43*c* of the second helical blade 43*a* was set to a position facing the proximity portion 55 of the first helical blade 44*a*. In the first example (FIG. 6), the blade apex portion 43*c* of the second helical blade 43*a* was set to a position facing the end surface portion 22*f*1 of the communication portion 22*f* on the downstream side of the second conveyance path 22*c*. In the second example (FIG. 7), the blade apex portion 43*c* of the second helical blade 43*a* was set to a position not facing the communication portion 22*f*, in other words, the blade apex portion 43*c* was set to a position facing the side opposite to the communication portion 22*f*. In the third example (FIG. 8), the blade apex portion 43*c* of the second helical blade 43*a* was set to a position facing the end surface portion 22*f*2 of the communication portion 22*f* on the upstream side of the second conveyance path 22*c*.

Under the state where the comparison example A and the first to third examples were set as described above, new developer was replenished into the developing container 22. Next, the first helical blade 44*a* and the second helical blade 43*a* were rotated for ten minutes, and then surplus developer was discharged. After that, measurement was performed as to whether or not an appropriate amount of developer (appropriate amount of residual developer: 380 g±5 g) has been left in the developing container 22.

Table 1 below shows the results of measurement of the amount of residual developer in the comparison example A and the first to third examples.

TABLE 1

| | Comparison Example A | First Example | Second Example | Third Example |
|---|---|---|---|---|
| Amount of Residual Developer | 413 g | 388 g | 376 g | 379 g |

The following facts are clearly understood from Table 1. In the comparison example A, although the amount of residual developer is much larger than the appropriate amount of residual developer, the discharge amount of surplus developer was markedly small. In the first example, although the amount of residual developer is slightly larger than the appropriate amount of residual developer, the discharge amount of surplus developer fell within a range of a substantially appropriate amount. In the second and third examples, the amount of residual developer fell within a range of an appropriate amount, and the discharge amount of surplus toner was appropriate. Those results prove that surplus developer is discharged by an appropriate amount when the blade apex portion 43*c* of the second helical blade 43*a* is positioned within the effective angular range, that is, within the range of from the position facing the end surface portion 22*f*1 of the communication portion 22*f* on the downstream side of the second conveyance path 22*c* to the position immediately before the position facing the proximity portion 55 of the first helical blade 44*a*, which is reached in accordance with the phase shift of the helical blade. It is more desired that the blade apex portion 43*c* of the second helical blade 43*a* be at the position not facing the communication portion 22*f* and the position facing the end surface portion 22*f*2 of the communication portion 22*f* on the upstream side of the second conveyance path 22*c*.

The present disclosure can be used for a developing device to be used in an image forming apparatus such as an electrophotographic copier, a printer, a facsimile, and a composite apparatus having functions of those devices, and for an image forming apparatus including the developing device. In particular, the present disclosure can be used for a developing device which replenishes a two-component developer including toner and carrier and discharges surplus developer and for an image forming apparatus including the developing device.

What is claimed is:

1. A developing device, comprising:

a first stirring member comprising a first helical blade extending along an axial direction around a rotary shaft;

a second stirring member comprising a second helical blade formed at the same blade pitch as a blade pitch of the first helical blade, the second helical blade extending along an axial direction around a rotary shaft;

a first conveyance path in which developer is conveyed from an upstream side to a downstream side by the first helical blade;

a second conveyance path in which the developer is conveyed from an upstream side to a downstream side by the second helical blade and which extends adjacently to and in parallel with the first conveyance path;

a partition member for separating the first conveyance path and the second conveyance path from each other;

a communication portion provided on each end portion side of the partition member in a long side direction so as to circulate the developer in the first conveyance path and the second conveyance path;

a developer replenishing port for replenishing developer into one of the first conveyance path and the second conveyance path;

a developer discharge port formed at a downstream end portion of the first conveyance path, for discharging surplus developer; and a regulating member constructed of a helical blade which faces the developer discharge port and is provided around the rotary shaft of the first stirring member adjacently to the first helical blade, the helical blade being formed in a reverse phase with respect to the first helical blade, wherein, when a proximity portion at which the first helical blade and the regulating member become closest to each other is at a position facing the communication portion, a blade apex portion of the second helical blade is arranged at a position not facing the communication portion, and in addition the number of blade apex portions of the second helical blade facing the communication portion is zero, wherein the first stirring member and the second stirring member are driven at the same rotational speed, wherein the first and second helical blades have opposite phases to each other, and wherein the first and the second helical blades rotate in the same direction.

2. An image forming apparatus comprising the developing device according to claim 1.

3. The developing device according to claim 1, wherein an opening width of the communication portion equals half the blade pitch.

4. A developing device, comprising:

a first stirring member comprising a first helical blade extending along an axial direction around a rotary shaft;

a second stirring member comprising a second helical blade formed at the same blade pitch as a blade pitch of the first helical blade, the second helical blade extending along an axial direction around a rotary shaft;

a first conveyance path in which developer is conveyed from an upstream side to a downstream side by the first helical blade;

a second conveyance path in which the developer is conveyed from an upstream side to a downstream side by the second helical blade and which extends adjacently to and in parallel with the first conveyance path;

a partition member for separating the first conveyance path and the second conveyance path from each other;

a communication portion provided on each end portion side of the partition member in a long side direction so as to circulate the developer in the first conveyance path and the second conveyance path;

a developer replenishing port for replenishing developer into one of the first conveyance path and the second conveyance path;

a developer discharge port formed at a downstream end portion of the first conveyance path, for discharging surplus developer; and a regulating member constructed of a helical blade which faces the developer discharge port and is provided around the rotary shaft of the first stirring member adjacently to the first helical blade, the helical blade being formed in a reverse phase with respect to the first helical blade, wherein, when a proximity portion at which the first helical blade and the regulating member become closest to each other is at a position facing the communication portion, a blade apex portion of the second helical blade is arranged at a position not facing the communication portion, and in addition the number of blade apex portions of the second helical blade facing the communication portion is zero, wherein one of the first stirring member and the second stirring member is driven at a rotational speed corresponding to an integral multiple of a rotational speed of another of the first stirring member and the second stirring member, wherein the first and second helical blades have opposite phases to each other, and wherein the first and the second helical blades rotate in the same direction.

5. The developing device according to claim 4, wherein an opening width of the communication portion equals half the blade pitch.

6. An image forming apparatus comprising the developing device according to claim 4.

* * * * *